US011028725B2

(12) United States Patent
Chaudhry et al.

(10) Patent No.: US 11,028,725 B2
(45) Date of Patent: Jun. 8, 2021

(54) ADAPTIVE MORPHING ENGINE GEOMETRY

(71) Applicant: United Technologies Corporation, Farmington, CT (US)

(72) Inventors: Zaffir A. Chaudhry, South Glastonbury, CT (US); Andrzej Ernest Kuczek, Bristol, CT (US); Dilip Prasad, North Granby, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 190 days.

(21) Appl. No.: 16/219,240

(22) Filed: Dec. 13, 2018

(65) Prior Publication Data

US 2020/0191011 A1 Jun. 18, 2020

(51) Int. Cl.
*F01D 17/12* (2006.01)

(52) U.S. Cl.
CPC ..... *F01D 17/12* (2013.01); *F05D 2240/12* (2013.01)

(58) Field of Classification Search
None
See application file for complete search history.

(56) References Cited

U.S. PATENT DOCUMENTS 4,109,885 A * 8/1978 Pender ..... B64C 21/06 244/118.1
4,619,580 A 10/1986 Snyder
5,181,678 A * 1/1993 Widnall ..... B64C 3/48 244/219
5,248,116 A * 9/1993 Rauckhorst ..... B64D 15/166 244/134 A
8,409,691 B1 * 4/2013 Henry ..... B32B 5/028 428/174
8,506,257 B2 8/2013 Bottome et al.
2005/0276688 A1 * 12/2005 Roth-Fagaraseanu ..... C23C 28/042 415/173.4
2009/0142608 A1 * 6/2009 Lineman ..... C04B 37/025 428/472
2009/0260345 A1 * 10/2009 Chaudhry ..... F02K 3/025 60/226.3
2010/0329851 A1 12/2010 Nilsson
2011/0042524 A1 2/2011 Hemmelgarn et al.
(Continued)

FOREIGN PATENT DOCUMENTS

EP 2965985 A1 1/2016
EP 3232008 A1 10/2017
(Continued)

OTHER PUBLICATIONS

European Search Report dated May 15, 2020 issued for corresponding European Patent Application No. 19215807.9.

*Primary Examiner* — Michael Lebentritt
(74) *Attorney, Agent, or Firm* — Bachman & LaPointe, P.C.

(57) ABSTRACT

A morphing aerodynamic control surface geometry comprising a control surface having an articulated portion comprising a flexible skin coupled at an exterior of the articulated portion, the flexible skin comprising opposed interlocking elements sandwiched within a flexible polymer coupled to the interlocking elements; wherein the flexible skin is configured compliant responsive to an articulation of the articulated portion.

22 Claims, 3 Drawing Sheets

(56) References Cited

U.S. PATENT DOCUMENTS

| | | | | |
|---|---|---|---|---|
| 2011/0114791 | A1* | 5/2011 | Henry | B29C 70/088 244/123.6 |
| 2012/0045318 | A1 | 2/2012 | LaMaster et al. | |
| 2012/0148794 | A1* | 6/2012 | Keller | F01D 5/288 428/117 |
| 2014/0140830 | A1* | 5/2014 | Hurlin | F02K 1/085 415/182.1 |
| 2014/0205793 | A1* | 7/2014 | Henry | D06M 15/55 428/111 |
| 2016/0273517 | A1* | 9/2016 | Betran Palomas | F03D 7/0236 |
| 2017/0298758 | A1 | 10/2017 | Mears | |
| 2018/0223867 | A1 | 8/2018 | Jemora et al. | |
| 2018/0258791 | A1* | 9/2018 | Kottilingam | F01D 25/005 |
| 2019/0202543 | A1* | 7/2019 | Gatto | F03D 1/0633 |
| 2019/0367156 | A1* | 12/2019 | Dickey | F16B 1/02 |
| 2020/0123904 | A1* | 4/2020 | Clark | F01D 25/005 |

FOREIGN PATENT DOCUMENTS

| | | | |
|---|---|---|---|
| GB | 2475376 | A | 5/2011 |
| WO | 2014025944 | A2 | 2/2014 |

* cited by examiner

ADAPTIVE MORPHING ENGINE GEOMETRY

BACKGROUND

The present disclosure is directed to an adaptive morphing engine geometry. Particularly, the disclosure includes an adaptive compliant skin for aerodynamic surfaces of gas turbine engines. The adaptive compliant skin can be configured as a morphing aerodynamic control surface geometry.

In order to improve the performance of a compressor, one or more of the stator stages may include variable stator vanes, or variable vanes, configured to be rotated about their longitudinal or radial axes. Such variable stator vanes generally permit compressor efficiency and operability to be enhanced by controlling the amount of air flowing into and through the compressor by varying the angle at which the stator vanes are oriented relative to the flow of air.

The compressor section may include a row of variable stator vanes downstream from the inlet guide vanes. During various operating conditions, such as startup and shut down of the gas turbine, the inlet guide vanes and the variable stator vanes may be actuated between an open position and a closed position so as to increase or decrease a flow rate of the working fluid entering the compressor section of the gas turbine.

These components represent a compromise between different engine regimes. This compromise reduces the efficiency under certain operating conditions.

What is needed is an adaptive morphing engine geometry without the drawbacks presented above.

SUMMARY

In accordance with the present disclosure, there is provided a morphing aerodynamic control surface geometry comprising a control surface having an articulated portion comprising a flexible skin coupled at an exterior of the articulated portion, the flexible skin comprising opposed interlocking elements sandwiched within a flexible polymer coupled to the interlocking elements; wherein the flexible skin is configured compliant responsive to an articulation of the articulated portion.

In another and alternative embodiment, the articulated portion is part of a gas turbine engine component selected from the group consisting of a variable geometry splitter, gas flow path, a static engine component, a variable inlet guide vane and an adaptive flap.

In another and alternative embodiment, the interlocking elements comprise at least one upper element and at least one lower element opposite the at least one upper element.

In another and alternative embodiment, the at least one upper element comprises an upper element exterior surface and an upper element interior feature opposite the upper element exterior surface; the at least one lower element comprises a lower element exterior surface and a lower element interior feature opposite the lower element exterior surface; the upper element interior feature configured to interlock with the lower element interior feature.

In another and alternative embodiment, the upper element interior feature and the lower element interior feature comprises inverted edges along a portion of the upper element and the lower element respectively.

In another and alternative embodiment, the at least one upper element comprises an upper element exterior surface and an upper element interior surface having a feature opposite the upper element exterior surface; the at least one lower element comprises a lower element exterior surface and a lower element interior surface with a feature opposite the lower element exterior surface; the upper element interior feature configured to interlock with a lower element interior feature.

In another and alternative embodiment, the upper element interior feature comprises a peg extending out of a portion of the upper element interior surface and the lower element interior feature comprises a receiver formed in the lower element interior surface.

In another and alternative embodiment, the flexible polymer surrounding the interlocking elements comprises a high temperature polymer volcanized to the interlocking elements.

In another and alternative embodiment, the flexible polymer comprises a lower stiffness than the interlocking elements.

In another and alternative embodiment, the interlocking elements are configured to interlock with a predetermined limit to slide and rotate relative to each other and maintain contact.

In another and alternative embodiment, the control surface is configured to articulate into a curved surface configured to produce an aerodynamic effect on a gas passing over the control surface.

In another and alternative embodiment, the inverted edges comprise corners bend into flat hooks facing the interior surface for each of the upper element and the lower element.

In another and alternative embodiment, the inverted edges of the upper element and the inverted edges of the lower element interlock at the corners.

In another and alternative embodiment, the interlocking elements sandwiched within the flexible polymer are configured in a mosaic pattern.

In another and alternative embodiment, the interlocking elements comprise at least one of a metal material and a ceramic composite material.

In another and alternative embodiment, the interlocking elements sandwiched within the flexible polymer are configured in a spaced apart pattern.

In another and alternative embodiment, the interlocking elements sandwiched within the flexible polymer comprise a smooth exterior surface.

In another and alternative embodiment, the interlocking elements are bonded together by the flexible polymer.

In another and alternative embodiment, the interlocking elements sandwiched within the flexible polymer comprise polygonal shapes.

In another and alternative embodiment, the interlocking elements sandwiched within the flexible polymer are formed in multiple layers.

Adaptive structural/aerodynamic elements which are comprised of flexible skins can facilitate shapes which are most efficient for the different operating regimes. These shape-morphing structures can be applied both to airfoils and flow-paths.

Other details of the adaptive morphing engine geometry are set forth in the following detailed description and the accompanying drawings wherein like reference numerals depict like elements.

DETAILED DESCRIPTION

Figure 1:
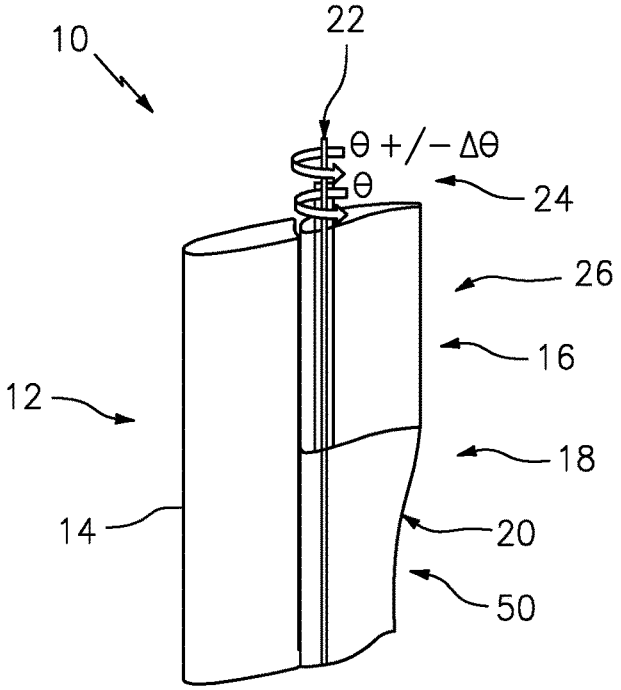
FIG. 1 is a schematic representation of an adaptive flap for a turbine engine.
Figure 3:
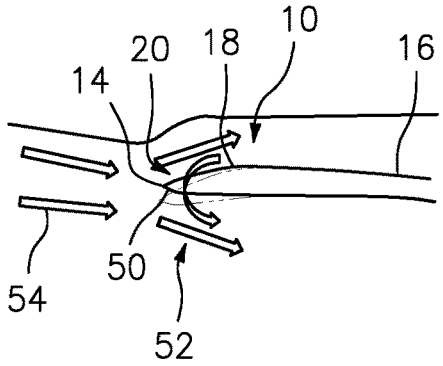
FIG. 3 is a schematic representation of an exemplary adaptive flap for turbine engine with a morphing aerodynamic control surface geometry.
Figure 2:
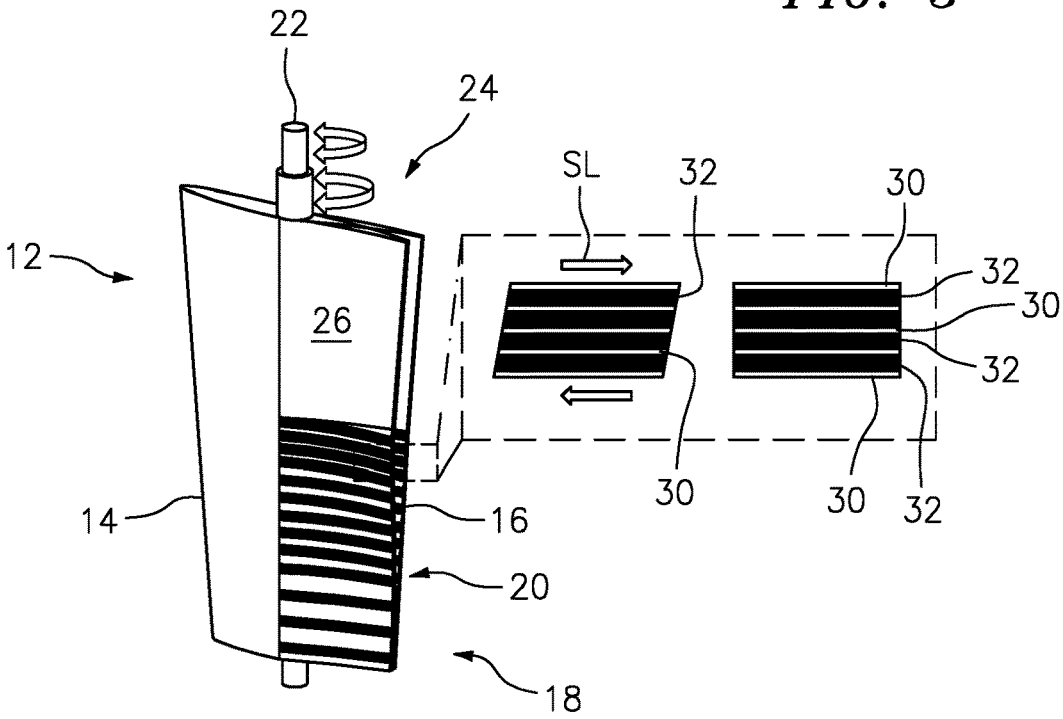
FIG. 2 is a schematic representation of an exemplary variable geometry splitter for a turbine engine.
Figure 4:
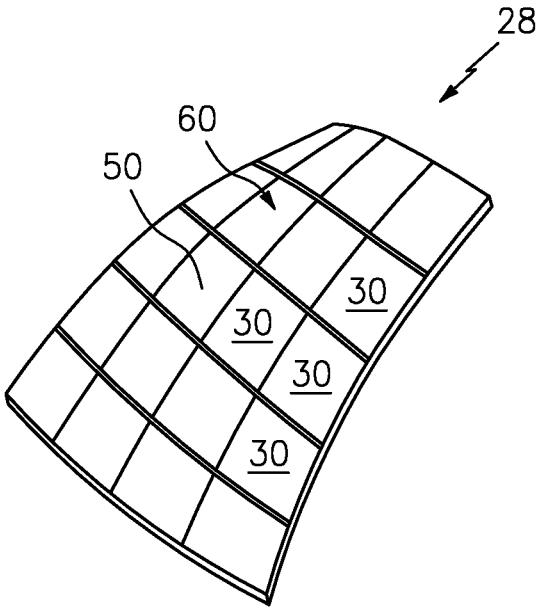
FIG. 4 is a schematic representation of an exemplary flexible skin.

Referring now to FIGS. 1-3, there is illustrated a turbine engine component 10, such as a variable inlet guide vane, a variable geometry splitter, gas flow path, a static engine component, and an adaptive flap. The turbine engine component 10 has an airfoil portion 12 with a leading edge 14 and a trailing edge 16. The component 10 includes a control surface 18 covering an articulated portion 20. The articulated portion 20 is shown proximate the trailing edge 16 but can also be located proximate the leading edge 14 and portions between the leading edge 14 and trailing edge 16. An axis 22 can be utilized to manipulate the articulated portion 20. In the exemplary embodiments shown in FIGS. 1 and 2 the axis 22 is a pivot for a flap 24 to rotate about.

The articulated portion 20 includes an exterior 26. A flexible skin 28 is coupled to the exterior 26 of the articulated portion 20. The flexible skin 28 is configured to be compliant responsive to an articulation of the articulated portion 20.

Referring also to FIGS. 4 to 8, the flexible skin 28 includes opposed interlocking elements 30. The interlocking elements 30 can be sandwiched between a flexible polymer 32. Polyurethane based elastomers have an excellent combination of high strength, toughness and low modulus and may be one of the candidates for achieving the "shape-change" functionality. The interlocking elements 30 can be bonded together by the flexible polymer 32. The interlocking elements 30 sandwiched within the flexible polymer can be configured in a mosaic pattern 60 and can be spaced apart. The interlocking elements 30 comprise at least one of a metal material and a ceramic composite material.

The interlocking elements 30 can be formed into polygonal, square, rectangle, triangle shapes and the like. The interlocking elements 30 can be sandwiched with the flexible polymer 32 in multiple layers as seen at FIG. 2. The flexible polymer 32 surrounding the interlocking elements 30 can comprise a high temperature polymer volcanized to the interlocking elements 30. The adhesive joint between the flexible polymer 32 and the interlocking elements 30 can be constructed from stiffer materials like aluminum or other light metals, for example, an aluminum surface can be treated with a phosphoric acid etching process to grow an oxide surface having a rough topography. If the adhesive/elastomer is able to fully wet this surface the bond strength will be increased.

In an exemplary embodiment, the flexible polymer 32 comprises a lower stiffness than the interlocking elements 30, such that when a torque is applied to the axis 22 the articulated portion 20 shifts the flexible skin 28 to place the flexible polymer 32 into a shear load SL, such that the flexible polymer 32 is displaced in the direction of the load. The desired curvilinear shape of the control surface 18 is achieved. The interlocking elements 30 are configured to interlock with a predetermined limit to slide and rotate relative to each other and maintain contact with each other. The control surface 18 is configured to articulate into a curved surface 50 configured to produce an aerodynamic effect 52 on a gas 54 passing over said control surface 18.

In another exemplary embodiment the trailing edge 16 is altered by the nonlinear stiffness of the control surface 18 having the flexible polymer 32 sandwiching the relatively stiff interlocking elements 30 in combination of thicknesses on the interlocking elements 30 and the layers of flexible polymer 32 (see insert of FIG. 2).

The interlocking elements 30 comprise at least one upper element 34 and at least one lower element 36 opposite the at least one upper element 34. The upper element 34 comprises an upper element exterior surface 38 and an upper element interior feature 40 opposite the upper element exterior surface 40. The lower element 36 comprises a lower element exterior surface 42 and a lower element interior feature 44 opposite the lower element exterior surface 42. The upper element interior feature 40 is configured to interlock with the lower element interior feature 44. In an exemplary embodiment, the upper element exterior surface 38 and the lower element exterior surface 42 can comprise a smooth exterior surface.

Figure 5:
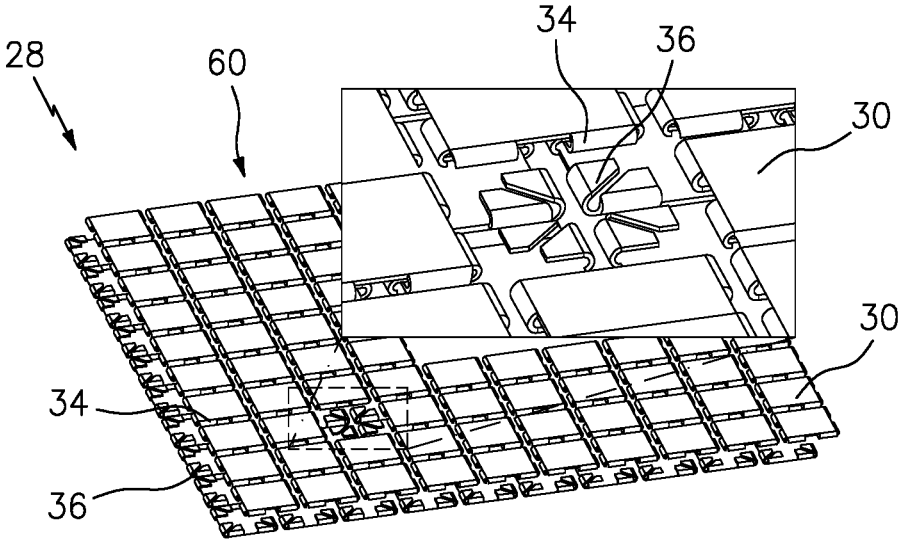
FIG. 5 is a schematic representation of an exemplary flexible skin.
Figure 6:
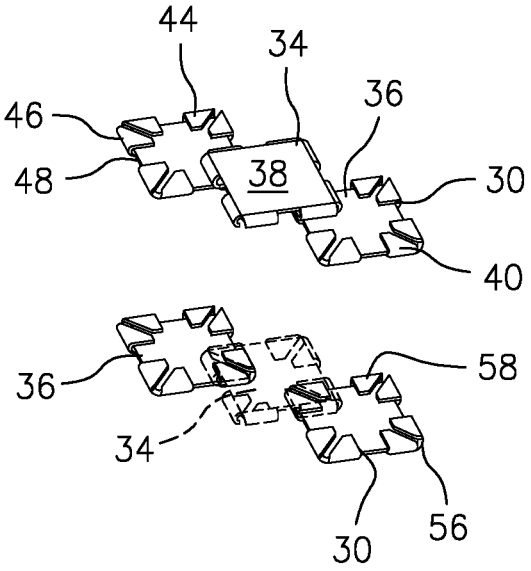
FIG. 6 is a schematic representation of a portion of an exemplary interlocking elements.
Figure 7:
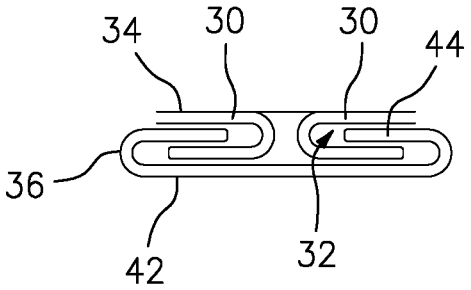
FIG. 7 is a cross sectional schematic representation of a portion of exemplary interlocking elements within a flexible polymer.

In an exemplary embodiment shown at FIGS. 5-7, the upper element interior feature 40 and the lower element interior feature 44 comprise inverted edges 46 along a portion or edge 48 of the upper element 34 and the lower element 36 respectively. In another exemplary embodiment, the inverted edges 46 comprise corners 56 bend into flat hooks 58 facing the interior surface for each of the upper element 34 and the lower element 36. The inverted edges 46 of the upper element 34 and the inverted edges 46 of the lower element 36 can interlock at the corners 56.

Figure 8:
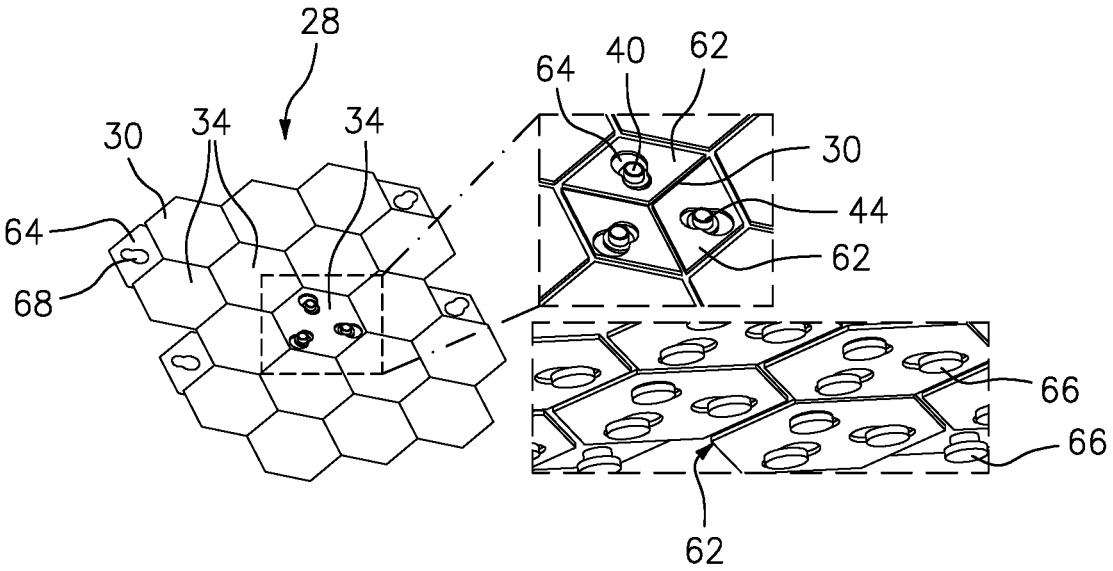
FIG. 8 is a schematic representation of exemplary interlocking elements in multiple views.

In another exemplary embodiment as seen in FIG. 8, the upper element 34 can include the upper element exterior surface 38 and an upper element interior surface 62 having a feature 40 opposite the upper element exterior surface 38. The lower element 36 can include the lower element exterior surface 42 and a lower element interior surface 64 with a feature 44 opposite the lower element exterior surface 42. The upper element interior feature 40 can be configured to interlock with the lower element interior feature 44. In an exemplary embodiment, the upper element interior feature 40 can include a peg 66 extending out of a portion of the upper element interior surface 62. The lower element interior feature 44 can include a receiver 68 formed in the lower element interior surface 64

The morphing aerodynamic control surface geometry provides the advantage of significant aerodynamic performance improvement by morphing static engine components.

The morphing aerodynamic control surface geometry provides the advantage of designing an adaptive flap to assume different optimal shapes at high-power, where through-flow is important, and at partial power, where stability concerns dominate.

The morphing aerodynamic control surface geometry provides the advantage of shape-morphing structures that can be enablers when applied to the flow-path.

The morphing aerodynamic control surface geometry provides the advantage in applications with a splitter of a 3-stream fan, where changes in bypass ratio may result in excessive splitter loading.

The morphing aerodynamic control surface geometry provides the advantage in applications with engine components such as the variable inlet guide vane and the flow splitters that have a fixed geometry.

The morphing aerodynamic control surface geometry provides the advantage for adaptive structural/aerodynamic elements which can include flexible skins that can facilitate shapes which are most efficient for the different operating regimes.

The morphing aerodynamic control surface geometry provides the advantage for shape-morphing structures that can be applied both to airfoils and flow-paths.

There has been provided an adaptive morphing engine geometry. While the adaptive morphing engine geometry has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A morphing aerodynamic control surface geometry comprising:

a control surface having an articulated portion comprising a flexible skin coupled at an exterior of said articulated portion, said flexible skin comprising opposed interlocking elements sandwiched within a flexible polymer coupled to said interlocking elements; wherein said flexible skin is configured compliant responsive to an articulation of said articulated portion; said interlocking elements comprise at least one upper element and at least one lower element opposite said at least one upper element; said at least one upper element comprises an upper element exterior surface and an upper element interior surface having a feature opposite said upper element exterior surface; said at least one lower element comprises a lower element exterior surface and a lower element interior surface with a feature opposite said lower element exterior surface; said upper element interior feature configured to interlock with a lower element interior feature; said upper element interior feature comprises a peg extending out of a portion of said upper element interior surface and said lower element interior feature comprises a receiver formed in said lower element interior surface.

2. The morphing aerodynamic control surface geometry according to claim 1, wherein said articulated portion is part of a gas turbine engine component selected from the group consisting of a variable geometry splitter, gas flow path, a static engine component, a variable inlet guide vane and an adaptive flap.

3. The morphing aerodynamic control surface geometry according to claim 1, wherein said flexible polymer surrounding said interlocking elements comprises a high temperature polymer volcanized to said interlocking elements.

4. The morphing aerodynamic control surface geometry according to claim 1, wherein said flexible polymer comprises a lower stiffness than said interlocking elements.

5. The morphing aerodynamic control surface geometry according to claim 1, wherein said interlocking elements are configured to interlock with a predetermined limit to slide and rotate relative to each other and maintain contact.

6. The morphing aerodynamic control surface geometry according to claim 1, wherein said control surface is configured to articulate into a curved surface configured to produce an aerodynamic effect on a gas passing over said control surface.

7. The morphing aerodynamic control surface geometry according to claim 1, wherein said interlocking elements sandwiched within said flexible polymer are configured in a mosaic pattern.

8. The morphing aerodynamic control surface geometry according to claim 1, wherein said interlocking elements comprise at least one of a metal material and a ceramic composite material.

9. The morphing aerodynamic control surface geometry according to claim 1, wherein said interlocking elements sandwiched within said flexible polymer are configured in a spaced apart pattern.

10. The morphing aerodynamic control surface geometry according to claim 1, wherein said interlocking elements sandwiched within said flexible polymer comprise a smooth exterior surface.

11. The morphing aerodynamic control surface geometry according to claim 1, wherein said interlocking elements are bonded together by said flexible polymer.

12. The morphing aerodynamic control surface geometry according to claim 1, wherein said interlocking elements sandwiched within said flexible polymer comprise polygonal shapes.

13. The morphing aerodynamic control surface geometry according to claim 1, wherein said interlocking elements sandwiched within said flexible polymer are formed in multiple layers.

14. A morphing aerodynamic control surface geometry comprising:

a control surface having an articulated portion comprising a flexible skin coupled at an exterior of said articulated portion, said flexible skin comprising opposed interlocking elements sandwiched within a flexible polymer coupled to said interlocking elements; said flexible skin is configured compliant responsive to an articulation of said articulated portion; said interlocking elements comprise at least one upper element and at least one lower element opposite said at least one upper element; said at least one upper element comprises an upper element exterior surface and an upper element interior feature opposite said upper element exterior surface; said at least one lower element comprises a lower element exterior surface and a lower element interior feature opposite said lower element exterior surface; said upper element interior feature configured to interlock with the lower element interior feature; said upper element interior feature and said lower element interior feature comprises inverted edges along a portion of said upper element and said lower element respectively; said inverted edges comprise corners bend into flat hooks facing said interior surface for each of said upper element and said lower element.

15. The morphing aerodynamic control surface geometry according to claim 14, wherein said inverted edges of said upper element and said inverted edges of said lower element interlock at said corners.

16. The morphing aerodynamic control surface geometry according to claim 14, wherein said interlocking elements sandwiched within said flexible polymer are configured in a mosaic pattern.

17. The morphing aerodynamic control surface geometry according to claim 14, wherein said interlocking elements comprise at least one of a metal material and a ceramic composite material.

18. The morphing aerodynamic control surface geometry according to claim 14, wherein said interlocking elements sandwiched within said flexible polymer are configured in a spaced apart pattern.

19. The morphing aerodynamic control surface geometry according to claim 14, wherein said interlocking elements sandwiched within said flexible polymer comprise a smooth exterior surface.

20. The morphing aerodynamic control surface geometry according to claim 14, wherein said interlocking elements are bonded together by said flexible polymer.

21. The morphing aerodynamic control surface geometry according to claim 14, wherein said interlocking elements sandwiched within said flexible polymer comprise polygonal shapes.

22. The morphing aerodynamic control surface geometry according to claim 14, wherein said interlocking elements sandwiched within said flexible polymer are formed in multiple layers.

* * * * *